US010377519B2

(12) United States Patent
Brandenburger et al.

(10) Patent No.: US 10,377,519 B2
(45) Date of Patent: Aug. 13, 2019

(54) INSTALLATION FOR ASEPTIC FILLING OF A RECEPTACLE

(71) Applicant: Fresenius Kabi Deutschland GmbH, Bad Homburg (DE)

(72) Inventors: Torsten Brandenburger, Reichelsheim (DE); Bernhard Neisius, Reichelsheim (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 505 days.

(21) Appl. No.: 15/024,911

(22) PCT Filed: Sep. 22, 2014

(86) PCT No.: PCT/EP2014/070135
§ 371 (c)(1),
(2) Date: Mar. 25, 2016

(87) PCT Pub. No.: WO2015/044088
PCT Pub. Date: Apr. 2, 2015

(65) Prior Publication Data

US 2016/0244195 A1 Aug. 25, 2016

(30) Foreign Application Priority Data

Sep. 25, 2013 (EP) ..... 13185858

(51) Int. Cl.
*B65B 55/10* (2006.01)
*B65B 39/06* (2006.01)
(Continued)

(52) U.S. Cl.
CPC ..... *B65B 55/10* (2013.01); *B65B 7/28* (2013.01); *B65B 39/06* (2013.01); *B65B 43/46* (2013.01);
(Continued)

(58) Field of Classification Search
CPC ..... B65B 55/022; B65B 55/10; B65B 55/027; B65B 39/06; B65B 7/28; B65B 43/46;
(Continued)

(56) References Cited

U.S. PATENT DOCUMENTS 2,930,170 A * 3/1960 Holsman ..... B65B 31/08 53/268
3,350,839 A * 11/1967 Carter ..... B67B 3/24 53/510

(Continued)

FOREIGN PATENT DOCUMENTS

| | | |
|---|---|---|
| EP | 0072699 | 2/1983 |
| EP | 1067052 | 1/2001 |
| EP | 2028108 | 2/2009 |

*Primary Examiner* — Alexander M Valvis
*Assistant Examiner* — Thomas M Wittenschlaeger
(74) *Attorney, Agent, or Firm* — Occhiuti & Rohlicek LLP

(57) ABSTRACT

A method and an installation for aseptic filling of a receptacle with an enteral nutrition solution includes making available a filling device with a first sealing device preferably in a fixed position, and in which a first aseptic zone is provided, and wherein the first sealing device is located in a position having an opening; taking hold of a receptacle; guiding the receptacle to the first sealing device in such a way that the receptacle, bears sealingly on the opening of the first sealing device, and the first aseptic zone, in which at least an attachment piece of the receptacle is arranged at least in part, is closed; delivering a sterilizing agent, into the first aseptic zone, such that the channel of the attachment piece of the receptacle is at least partially sterilized; guiding the receptacle to the filling nozzle within the first aseptic zone in such a way that the filling nozzle protrudes at least partially into the channel of the attachment piece of the receptacle; filling the receptacle with the nutrition solution;
(Continued)

fitting a closure onto the channel of the attachment piece such that the filled receptacle is closed aseptically.

19 Claims, 3 Drawing Sheets

(51) Int. Cl.

| | |
|---|---|
| ***B65B 43/46*** | (2006.01) |
| ***B65B 7/28*** | (2006.01) |
| ***B65B 55/02*** | (2006.01) |
| ***B67C 7/00*** | (2006.01) |
| *B67C 3/22* | (2006.01) |
| *B67C 3/26* | (2006.01) |

(52) U.S. Cl.
CPC ..... *B65B 55/022* (2013.01); *B67C 7/00* (2013.01); *B67C 2003/228* (2013.01); *B67C 2003/2697* (2013.01)

(58) Field of Classification Search
CPC ..... B65B 31/046; B67C 2003/228; B67C 2003/2697; B67C 7/00
See application file for complete search history.

(56) References Cited

U.S. PATENT DOCUMENTS

| | | | | | |
|---|---|---|---|---|---|
| 3,393,491 | A * | 7/1968 | Burton | A61L 2/07 | 137/614.17 |
| 3,531,908 | A * | 10/1970 | Tuma | B65B 55/10 | 141/92 |
| 4,283,901 | A * | 8/1981 | Schieser | B65B 43/60 | 53/272 |
| 4,494,363 | A * | 1/1985 | Rica | B65B 55/022 | 53/109 |
| 4,519,184 | A * | 5/1985 | Brunswick | B65B 3/30 | 53/133.2 |
| 4,893,659 | A * | 1/1990 | Loliger | B65B 55/022 | 141/105 |
| 4,916,885 | A * | 4/1990 | Loliger | B65B 55/022 | 53/268 |
| 5,653,091 | A * | 8/1997 | Stark | B65B 55/04 | 53/167 |
| 6,070,622 | A * | 6/2000 | Rutter | B65B 39/004 | 141/10 |
| 6,330,780 | B1 * | 12/2001 | Shipway | B65B 55/022 | 53/268 |
| 9,586,801 | B2 * | 3/2017 | Macquet | B65B 7/2835 | |
| 9,592,924 | B2 * | 3/2017 | Decio | B65B 1/04 | |
| 2004/0222224 | A1 * | 11/2004 | Plester | B67C 7/0073 | 220/203.17 |

* cited by examiner

INSTALLATION FOR ASEPTIC FILLING OF A RECEPTACLE

CROSS REFERENCE TO RELATED APPLICATIONS

This application is a National Stage of International Application No. PCT/EP2014/070135, filed on Sep. 22, 2014, which claims priority to European Application No. 13185858.1, filed on Sep. 25, 2013, the contents of which are hereby incorporated by reference in their entirety.

The present invention relates to a method and to an installation for aseptic filling of a receptacle with a, preferably enteral, nutritional solution.

In contrast to aseptic filling installations, in the case of non-aseptic filling installations the filled and closed container has to be sterilized subsequently in order to guarantee the microbiological safety and long shelf life of the product. However, the availability of aseptic filling installations is clearly below that of conventional non-aseptic filling installations. In order to maintain aseptic filling, which manages without any energy-intensive subsequent sterilization, said filling installations, depending on the microbiological susceptibility of the product, are usually subject to a cleaning and sterilizing operation after several hours of production. As a rule, consequently, such filling devices aseptic filling installations are arranged inside an isolator which can be viewed as a reduced aseptic clean room inside the aseptic filling installation. Containers and closures are introduced by means of special air locks. The interior of the isolator is protected against possible contamination by a displacement flow that is brought about by overpressure. Aseptic filling installations are generally used for microbiologically sensitive products with a pH-value in excess of 4.

Publication DE 69 810 235 T2 relates to an aseptic filling machine of this type for flexible containers with a pressure cap. Said filling machine includes a sterile chamber in which the working operations for opening, filling and closing the container are carried out.

EP 1 067 052 A1 describes a device and a method for the sterile filling of a pouch which comprises a filling spout and a cap. The device includes a filling valve and a chamber, both of which are formed by one integral unit. The pouch to be filled is introduced into the chamber by means of clamping jaws via an open bottom side of the chamber. The pouch, the filling spout and the cap are sterilized in the chamber. Once the cap has been removed, the pouch is moved through the chamber and introduced to the filling nozzle and is then filled.

Where the surface to be cleaned inside the isolator gets larger and larger, however, the time and money spent on cleaning increases. Depending on the sensitivity of the product to be processed, said cleaning and sterilizing operation has to be carried out after a few hours of production in order to guarantee the aseptic state of the installation. In order to maintain the aseptic state of the installation, the product-carrying pipelines and the interior of the isolator, inside which the filling is effected, have to be cleaned and sterilized. Depending on the complexity of the installation and in particular on the size of the inside surface of the aseptic zone, such a cleaning cycle last several hours. As a result of the necessity for frequent cleaning and of the interrupted production this causes, there is less effective production time remaining for the filling installation. The availability of an aseptic filling installation can even be reduced to 60-70% as a result of the long cleaning and sterilizing operations.

It is an object of the invention to create an aseptic filling installation which enables greater availability.

Said object is achieved by the subject matter with the features according to the independent claims. Advantageous embodiments are the object of the description, the figures and the dependent claims.

The present invention relates to a method for aseptic filling of a receptacle with a nutritional solution.

The nutritional solution is preferably provided for enteral nutrition. The method includes the following steps:

provide a filling device with a first sealing device in which at least one filling nozzle is arranged, preferably in a fixed manner, and in which a first aseptic zone can be or is provided and wherein the first sealing device is situated in a position which comprises an opening and consequently the first sealing device and the first aseptic zone are situated in an open position;

grip a receptacle, which includes at least one connecting piece with a channel for filling the receptacle, by way of a gripper;

introduce the receptacle, preferably by means of the gripper, to the first sealing device in a first movement in such a manner that the receptacle, in particular the connecting piece of the receptacle, abuts sealingly against the opening of the first sealing device and the first aseptic zone, in which at least the connecting piece of the receptacle is arranged at least in portions, is closed or formed;

supply a sterilant, preferably by means of the filling nozzle, into the closed or formed first aseptic zone such that at least the channel of the connecting piece of the receptacle is sterilized at least in portions;

introduce the receptacle, preferably by means of the gripper, to the filling nozzle inside the first aseptic zone in a second movement that connects, preferably directly, to the first movement, in such a manner that the filling nozzle is able to fill the receptacle by means of the channel of the connecting piece of the receptacle and preferably the first sealing device is reduced in its longitudinal extension;

fill the receptacle through or by means of the channel in the connecting piece with the nutritional solution in the first aseptic zone by means of the filling nozzle; and fit or place a closure onto the channel of the connecting piece in an aseptic environment, preferably in a closing device, such that the filled receptacle is closed in an aseptic manner. For example, the aseptic environment is provided by a second aseptic zone which can be generated in a second sealing device which is arranged in the closing device (see the description below in this regard).

Within the scope of the invention is also an installation for, preferably aseptic, filling a receptacle which comprises at least one connecting piece with a channel for filling the receptacle with a, preferably enteral, nutritional solution. The installation includes:

a filling device with a first sealing device which comprises a closable opening and is adjustable preferably in the longitudinal extension and in which at least one filling nozzle is arranged, preferably in a fixed manner, and in which a first aseptic zone can be provided by means of closing the opening;

a gripper for gripping and introducing the receptacle to the first sealing device in a first movement in such a manner that the receptacle, in particular the connecting piece of the receptacle, can be placed in a sealing manner against the opening of the first sealing device and the first aseptic zone, in which at least one connecting piece of the receptacle is arranged at least in portions, can be closed; and wherein the gripper is realized for introducing the receptacle to the filling nozzle inside the first aseptic zone in a second movement which connects, preferably directly, to the first movement in such a manner that the filling nozzle projects at least in portions into the channel of the connecting piece of the receptacle and is able to fill the receptacle in the first aseptic zone. The filling device of the installation includes a device for supplying a sterilant into the prepared first aseptic zone such that at least the channel of the connecting piece of the receptacle is sterilizable at least in portions. The installation also includes a closing device for fitting a closure onto the connecting piece of the receptacle.

The method according to the invention can be carried out in particular by means of the installation according to the invention. The installation according to the invention is realized in particular to carry out the method according to the invention. The installation and/or the method according to the present invention can be used in particular for microbiologically sensitive products with a pH value of in excess of 4, for example for the filling of enteral nutritional compounds, in particular for clinical nutrition, the pH value of which is within the range of between 6 and 7.

Microbiological safety and a sufficiently long product shelf life have to be guaranteed. An aseptic zone is an environment which comprises the state of asepsis or which is essentially sterile. The reproduction of possible germs is essentially suppressed in said environment. Germs are microorganisms which can cause unhealthy processes in other organisms. In particular, the number of microorganisms capable of reproduction remaining after sterilization must not exceed a certain limit value. The sterile, aseptic or germ-free state or the sterile, aseptic or germ-free environment is defined by requirements or standards for enteral, clinical nutrition which are to be adhered to. After sterilization, the, preferably substantially all the, microorganisms capable of reproduction are killed off. The components or regions subjected or exposed to sterilization and/or the method steps carried out in a sterile environment are designated as sterile. The aim of aseptic production is to preserve the sterility of the nutrition arrangement which is made up by sterilized components.

The longitudinal extension of the first sealing device describes, as it were, the height of the first sealing device. This is modifiable in this case. In the present filling device, the longitudinal extension preferably extends in the direction of the filling nozzle axis and/or in the direction of the first and/or the second movement. As a result of the first sealing device which is modifiable in the longitudinal extension, it is ensured, in particular, that when the receptacle is introduced to the filling nozzle and/or when the receptacle is moved away from the filling nozzle, a closed unit per se is formed. As a result, the tightness of the first sealing device, in which the first aseptic zone is provided, is increased.

In one embodiment, the first sealing device is realized so as to be compressed when the receptacle is introduced to the filling nozzle. The first aseptic zone of the filling device is reduced in its longitudinal extension by the second movement in which the receptacle is introduced to the filling nozzle. In one development of the first sealing device, the first sealing device is defined by a side wall, the height of which is modifiable. The receptacle can be introduced to the filling nozzle by compressing the first sealing device or by reducing the height of the side wall of the first sealing device. The side wall of the first sealing device is formed in a first variant at least in portions by a bellows which extends, in particular, around the filling nozzle. In a second variant of the side wall, it is formed at least in portions by a telescopic system, which extends, in particular, around the filling nozzle, produced from pipes which can be displaced in relation to one another.

The receptacle to be filled is preferably provided with a closed, sterile interior and with a connecting piece which is sealed by way of a diaphragm which is puncturable, in particular by means of the filling nozzle. The diaphragm can be reclosable or not reclosable. The closed diaphragm and at least one channel of the connecting piece located above the closed diaphragm are sterilized by the sterilant. In one embodiment the device for supplying the sterilant is provided by the filling nozzle itself.

When the receptacle is introduced to the filling nozzle in the second movement, the filling nozzle can abut sealingly against the receptacle, preferably against the channel or the connecting piece. The receptacle is preferably introduced to the filling nozzle in the second movement in such a manner that the filling nozzle projects at least in portions into the channel of the connecting piece of the receptacle.

The sterilized diaphragm is opened prior to filling the receptacle. To this end, in one embodiment of the invention, the receptacle is introduced to such an extent to the filling nozzle in the second movement, which connects, preferably directly, to the first movement, that the sterilized diaphragm is punctured by the filling nozzle. The filling nozzle is preferably realized as a mandrel for opening, preferably puncturing, the diaphragm of the connecting piece of the receptacle. In one development, the filling nozzle, preferably the outside pipe of the filling nozzle, comprises a beveled end for opening or piercing the diaphragm. The filling nozzle is preferably moved so far into the connecting piece of the receptacle that an outside surface of the filling nozzle, preferably a sealing cone of the filling nozzle, abuts against the connecting piece and closes the channel, preferably in a sealing manner, in the connecting piece. To this end, the filling nozzle, preferably the outside pipe of the filling nozzle, in one development includes an outside sealing cone for sealing the filling nozzle in relation to the receptacle. The receptacle can now be filled.

The filling nozzle includes in one embodiment a first channel for supplying a, preferably enteral, sterile nutritional solution and a second channel for supplying a sterilant. In an alternative embodiment, the filling nozzle includes a first channel for supplying a sterilant and/or a sterile nutritional solution and a second channel for sucking out a sterilant and/or a nutritional solution. In one development of the filling nozzle, the first channel of the filling nozzle is formed by an inside pipe and the second channel of the filling nozzle by a, preferably concentric, outside pipe.

The closure is preferably provided as a closure cap which is fitted onto the channel of the connecting piece of the receptacle. The closure is preferably a tamper-evident closure, for example with a break-off and/or twist-off cap. In one embodiment, the closure is applied onto the channel of the connecting piece of the receptacle in a closing device. To this end, the filled receptacle is transported from the filling device to the closing device, preferably by means of the gripper. The closing device is provided with a second sealing device in which a closure gripper is arranged, preferably so as to be movable, and in which a second aseptic zone can be or is provided. In said development, the installation for aseptic filling consequently includes a closing device for fitting or placing a closure onto the channel of the connecting piece of the receptacle with a second sealing device which includes a closable opening. In said second sealing device, a second aseptic zone can be provided by means of closing the opening. In one development, the second sealing device is a protective bell. In one development, the protective bell comprises the named closable opening on a bottom surface.

The closure gripper, by way of which the closure is able to be placed or pressed onto the channel of the connecting piece by means of a, preferably pneumatic, device, is movably arranged in the second sealing device. A conveying system for providing a closure and a, preferably separate, gripping element for removing the closure from the conveying system and for transferring the closure to the closure gripper, which is positioned in the closing device, are preferably provided. The second sealing device of the closing device is opened for receiving the closure and the, preferably sterile, closure, which is fitted onto the connecting piece, is removed from the conveying system by way of the gripping element and transferred to the closure gripper which is positioned in the closing device in the open closing device.

The opening of the second sealing device of the closing device and/or the transferring of the closure to the closure gripper is/are preferably effected whilst the receptacle is provided for introduction to the opening of the first aseptic zone and/or whilst the receptacle is introduced to the opening of the first aseptic zone in the first movement and/or during the second movement when the receptacle is introduced to the filling nozzle.

In a subsequent step, the second sealing device of the closing device is closed and the closure, in particular even whilst the receptacle is filled in the filling device, is cleaned, sterilized and/or dried in the closed second sealing device. This is effected by a device for cleaning, sterilizing and/or drying.

Once the filling operation has been concluded, the filled receptacle is moved away from the filling nozzle in a third movement. In a fourth movement which connects, preferably directly, to the third movement, the filled receptacle is removed from the first sealing device such that the first aseptic zone is opened.

In a fifth movement which connects, preferably directly, to the fourth movement, the filled receptacle is moved from the filling device to the closing device such that at least the region of the connecting piece, in which the channel for filling, in particular the open diaphragm, is situated, is situated in a protective atmosphere. The protective atmosphere can be provided by a protective gas, for example including nitrogen and/or sterile air. The protective atmosphere, in this case, can be provided as a displacement flow.

In a sixth movement which connects, preferably directly, to the fifth movement, the receptacle is introduced in such a manner to the second sealing device of the closing device and placed in sealing abutment against it that a closed, second aseptic zone, in which the closure is fitted onto the connecting piece of the filled receptacle, is formed around the closure and at least around the region of the connecting piece in which the channel for filling, in particular the open diaphragm, is situated.

The receptacle, closed by way of the closure, is removed from the second sealing device in a seventh movement which connects, preferably directly, to the sixth movement such that the second aseptic zone is opened. The filled and now closed receptacle can then be supplied for further processing, for example for labeling and/or packaging.

Cleaning, sterilizing and/or drying of at least the filling nozzle in the filling device can be carried out parallel to or at the same time as the closing of the receptacle in the closing device. Cleaning, sterilizing and/or drying of at least the closure in the closing device can also be carried out parallel to or at the same time as the filling of the receptacle in the filling device. A movably arranged device for cleaning, sterilizing and/or drying, which can be placed in abutment against the first sealing device of the filling device and/or against the second sealing device of the closing device, is provided in one embodiment of the invention for this purpose. As a result, the first and/or the second sealing device and the components contained therein, such as, for example, the filling nozzle and/or the closure, can be cleaned, sterilized and/or dried after each filling operation. The device for cleaning, sterilizing and/or drying is preferably moved for this purpose back and forth between the first sealing device of the filling device and the second sealing device of the closing device. In the embodiment with the sealing plate, which is introduced in the text below, the device for cleaning, sterilizing and/or drying is arranged, preferably fastened, on the sealing plate. By displacing the sealing plate, the device for cleaning, sterilizing and/or drying is moved back and forth between the first sealing device of the filling device and the second sealing device of the closing device. For example, the device for cleaning, sterilizing and/or drying can also provide the displacement flow in the gap which is formed between the sealing plate and the carrier plate.

The receptacle, in particular the connecting piece of the receptacle, can abut directly or indirectly against the opening of the first and/or of the second sealing device for closing the first aseptic zone and/or the second aseptic zone. In the embodiment described in the text below with the sealing plate and subsequently the carrier plate, the receptacle, in particular the connecting piece of the receptacle, can abut indirectly against the opening of the first sealing device and/or against the opening of the second sealing device.

In one embodiment, the installation includes a sealing plate, wherein the receptacle, preferably the connecting piece of the receptacle, can be held in a sealing manner against an opening in the sealing plate, in particular by means of the gripper. The sealing plate for forming or closing the first aseptic zone can be placed in a sealing manner against the first sealing device. The sealing plate is preferably a displaceable sealing plate.

Once the filling operation has been concluded, the sealing plate together with the receptacle, which is held in a sealing manner against the opening of the sealing plate, is displaced away from the first sealing device, in particular by means of the gripper, and toward the closing device and is placed in abutment against the second sealing device for forming or closing the second aseptic zone.

In one embodiment, the first sealing device of the filling device abuts against a carrier plate to form the first aseptic zone. In particular, the first sealing device is connected to the carrier plate. In said development, the sealing plate can be placed in a sealing manner against the carrier plate, in particular by means of the gripper, for closing the first aseptic zone.

In a further embodiment, the second sealing device of the closing device is placed in abutment against the carrier plate to close or form the second aseptic zone. The protective bell is moved down onto the carrier plate and brought into sealing abutment in order to provide the second aseptic zone. The sealing plate for closing the second aseptic zone is placed in sealing abutment against the carrier plate, in particular by means of the gripper. The second sealing device of the closing device for forming the second aseptic zone can consequently be placed in abutment against the carrier plate.

The sealing plate, in particular together with the receptacle which is held in a sealing manner against the opening of the sealing plate, is displaced, preferably sideways, from the filling device to the closing device and/or vice versa, in particular by means of the gripper, thereby realizing a gap between the sealing plate and the carrier plate. The protective atmosphere is provided at least in the gap, for example by a displacement flow to the outside. The displacement flow can be a nitrogen flow, for example.

The first, second, third, fourth, fifth, sixth and seventh movements serve to differentiate between the individual method steps and, where applicable, to ascertain a sequence for the method steps. However, the movements do not have to be separate or discrete movements. The movements can also merge into one another. For example, the first and second movements can be carried out by the gripper one after another without interruption.

Considering the sealing plate and/or the carrier plate, the individual movements are effected in particular as follows:

The sealing plate, together with the receptacle, which is held in a sealing manner against the opening of the sealing plate, carries out the first movement, in particular by means of the gripper, by way of which the first aseptic zone is provided or closed and/or the sealing plate, together with the receptacle, which is held in a sealing manner against the opening of the sealing plate, and the carrier plate, carries out the second movement, in particular by means of the gripper, in which the receptacle is introduced in such a manner to the filling nozzle that the filling nozzle projects at least in portions into the channel of the connecting piece of the receptacle and/or the sealing plate, together with the receptacle, which is held in a sealing manner against the opening of the sealing plate, and the carrier plate, carries out the third movement, in particular by means of the gripper, in which the receptacle is removed from the filling nozzle and/or the sealing plate, together with the receptacle, which is held in a sealing manner against the opening of the sealing plate, carries out the fourth movement, in particular by means of the gripper, by way of which the first aseptic zone is opened and/or the sealing plate, together with the receptacle, which is held in a sealing manner against the opening of the sealing plate, carries out the fifth movement, in particular by means of the gripper, by way of which the filled receptacle is moved from the filling device to the closing device and/or the sealing plate, together with the receptacle, which is held in a sealing manner against the opening of the sealing plate, carries out the sixth movement, in particular by means of the gripper, by way of which the receptacle is introduced to the second sealing device of the closing device and is placed in sealing abutment against it in order to form or close the second aseptic zone and/or the sealing plate, together with the receptacle, which is held in a sealing manner against the opening of the sealing plate, carries out the seventh movement, in particular by means of the gripper, by way of which the receptacle which is closed by way of the closure is removed from the second sealing device such that the second aseptic zone is opened.

The movement of the receptacle, the sealing plate and/or the carrier plate can, as realized above, be effected by means of the gripper. However, the movement can also be effected without the assistance of the gripper. In this case, the gripper essentially serves for holding the receptacle. The movement can be effected, for example, by means of a movement which is provided by means of the sealing plate and/or by means of the carrier plate. The sealing plate and/or the carrier plate can have their own drive for this purpose.

Within the scope of the invention is also a receptacle which is fillable and displaceable and/or has been filled and closed according to the above-described method according to the invention. This is a receptacle which is filled with a liquid, sterile nutritional solution, has a connecting piece which is introduced on or into the receptacle with a diaphragm which is arranged in a channel, is punctured or broken open and, where applicable, has been opened; and a closure which is connected to the connecting piece and closes, preferably in an aseptic manner, the channel of the connecting piece. The receptacle is preferably a pouch or a stand-up pouch. In said development, the present invention is based on the concept of initially providing a closed, empty receptacle for a, preferably enteral, nutritional solution, the interior of which, on the one hand, is closed in a sterile manner and, on the other hand, in a hermetic manner in relation to the surrounding area. A sterile, preferably enteral nutritional solution is then filled into the sterile interior of the receptacle and is then closed under aseptic conditions by means of the installation and/or the method according to the present invention. As a result, a receptacle with a sterile nutritional solution is provided without the entire filled receptacle having to be finally autoclaved as has been usual up to now.

Further embodiments will be explained in more detail with reference to the accompanying drawings, in which.

The installation according to the invention for aseptic filling of a receptacle 105 with an enteral nutritional solution is not shown in its entirety in the figures for reasons of clarity. The components of the installation, namely the filling device 100 and the closing device 200 are shown and described here individually. The installation can include even more components. The filling device 100 and the closing device 200 can be arranged, for example, on a carousel.

Figure 1:
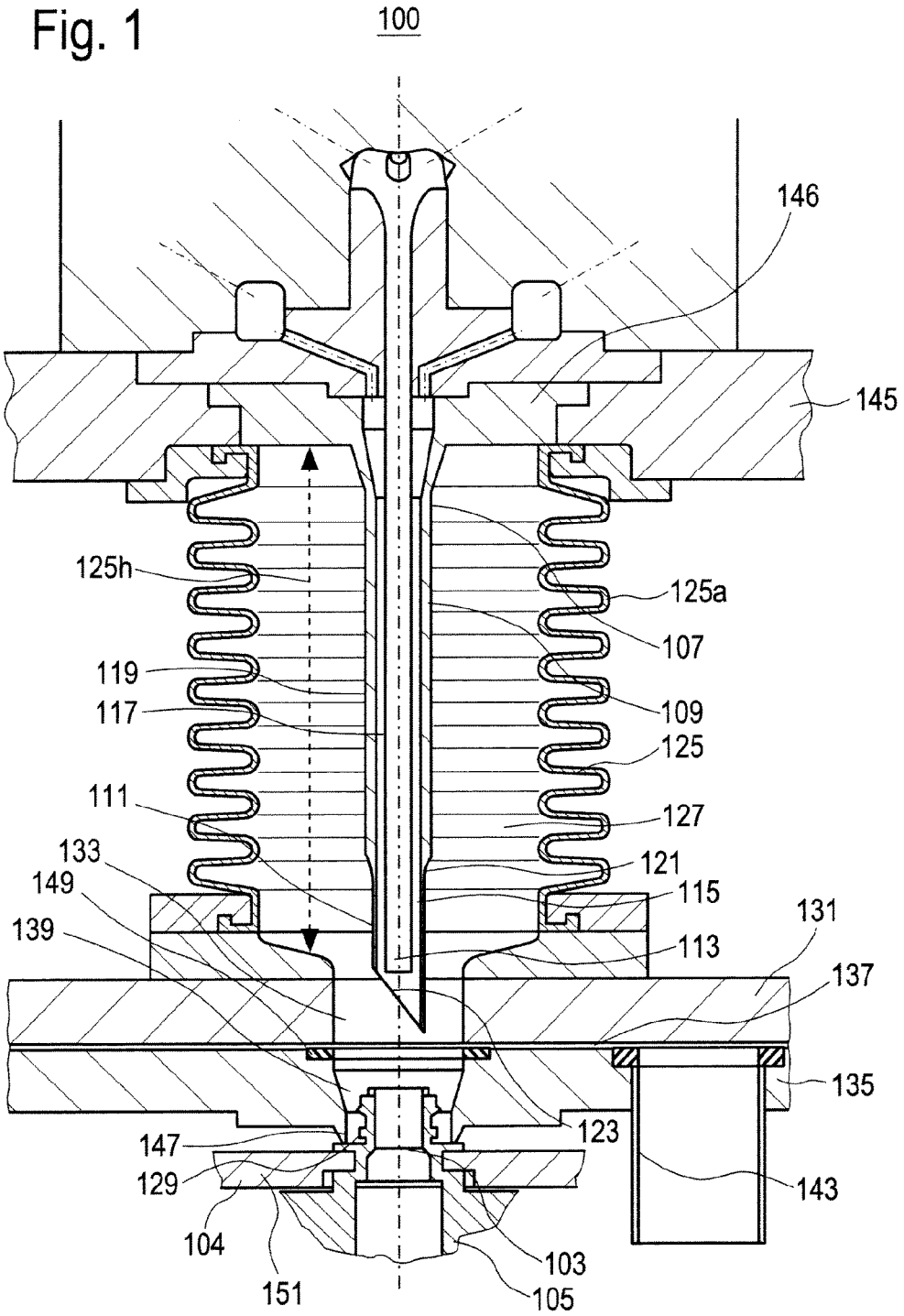
FIG. 1 shows a cross sectional view of a filling device of an installation for aseptic filling of a receptacle with an enteral nutritional solution.

FIG. 1 shows a cross sectional view of a filling device 100 of an installation for aseptic filling of a receptacle 105 with an enteral nutritional solution. The filling device 100 serves for aseptic filling of the receptacle 105 with a liquid, preferably for enteral clinical nutrition. The receptacle 105 in the embodiment shown is a pre-sterilized receptacle 105 which is closed by way of a diaphragm 103. The receptacle 105 has a connecting piece 129 with a channel 130 which is closed by way of the diaphragm 103. FIG. 1 shows the connecting piece 129 of the receptacle 105 and the diaphragm 103 which is arranged in the connecting piece 129 and in this case has not yet been opened. The receptacle 105 itself is not shown in FIG. 1.

The receptacle 105 can be, for example, a plastic pouch, a plastic bottle, a pouch, a stand-up pouch or any other receptacle which is suitable for receiving a liquid for enteral clinical nutrition. The connecting piece 129 of the receptacle 105 can be formed, for example, by a plastic body which comprises a, preferably cylindrical, channel 130. The connecting piece 129 can also be designated as a port.

The filling device 100 includes a first sealing device 125. A first aseptic zone 127 can be provided in said sealing device. The first aseptic zone 127 is characterized by a space that is closed or closable relative to the environment. The aseptic filling of the receptacle 105 is effected in said first aseptic zone 127. The filling nozzle 111 is arranged in the interior of the first aseptic zone 127 which is formed or provided by the first sealing device 125. The first sealing device 125 is modifiable in its longitudinal extension. The first sealing device 125 is preferably compressible or telescopic in particular in an axial and/or vertical manner. The first sealing device 125 includes side walls 125*a* which are modifiable in their longitudinal extension 125*h*. In the embodiment shown in FIG. 1, the side walls 125*a* of the first sealing device 125 are provided by a bellows. The bellows is a resilient hose which collapses like a harmonica, is produced from rubber or plastics material, is mounted around the filling nozzle 111 in order to protect said filling nozzle from contamination with germs and to seal it in relation to the environment. The first sealing device 125 can be formed, for example, by a rubber bellows which is mounted on its top surface on a base plate 145. In general, however, other devices which are suitable for preventing ingress of germs or contaminants can also be used as the first sealing device 125. In an alternative embodiment which is not shown here in the figures, the side walls 125*a* of the first sealing device 125 are provided by a telescopic system produced from tubes that can be displaced in relation to one another.

The first aseptic zone 127 is defined toward the top surface by the base plate 145. The first sealing device 125 is connected to the base plate 145 here by means of an annular flange 146. The base plate 145 comprises a feedthrough here. The filling nozzle is guided by the feedthrough. The filling nozzle 111 is arranged in the interior of the first aseptic zone 127 and is explained in more detail below.

The first aseptic zone 127 is defined toward the bottom surface by a carrier plate 131. This can also be designated as a bellows plate. The first sealing device 125 is connected to the carrier plate 131 which here is vertically displaceable. The carrier plate 131 includes an opening 133 for the passage of the filling nozzle 111. Said opening 133 provides the opening of the first aseptic zone 127 here. A sealing plate 135 is arranged beneath the carrier plate 131. The sealing plate 135 is arranged here so as to be horizontally displaceable in relation to the carrier plate 131.

FIG. 1 shows the filling device 100 during and/or shortly before the first movement. The receptacle 105 abuts in a sealing manner against the opening 135 in the carrier plate 131 by means of its connecting piece 129 and the sealing plate 135. The opening 135 is closed. The first aseptic zone 127 is not yet fully closed in said representation as the sealing plate 135 does not yet abut against the carrier plate 131 but is still at a spacing from the carrier plate 131. In the state shown, a gap 137 is formed between the sealing plate 135 and the carrier plate 131. A displacement flow to the outside toward the surrounding area is guided through the gap 137. As a result, the first aseptic zone 127 is shielded in relation to the surrounding area. The displacement flow can be, for example, a nitrogen flow. A flushing line 143, in particular a CIP/SIP flushing line, can be provided in the sealing plate 135 in particular for cleaning, for example as a device for cleaning, sterilizing and/or drying. The sterilizing is effected, for example, by means of a vapor blast and/or by means of hydrogen peroxide.

The sealing plate 135 comprises an opening 139 for the passage of the filling nozzle 111 and/or for the sealed insertion of a connecting piece 129 of the receptacle 105. A sealing ring 149 is provided on the top surface of the sealing plate 135. A cutting edge 147, which contacts the flange top surface of the receptacle 105 and seals it as a result of superficial material displacement, is provided on the bottom surface of the sealing plate 135. The receptacle 105 is held on the connecting piece 129 by a movement device 104, for example a gripper. The gripper 104 is arranged beneath the sealing plate 135.

A further opening in the sealing plate 135 is admitted laterally offset to the opening 139, through which the connecting piece 129 is guided to the filling nozzle 111. The flushing lines 143 are situated below said opening. A sterilant and/or sterile air, for example, can be supplied to and/or removed again from the first aseptic zone 127 and also subsequently the second aseptic zone 204 by means of said flushing lines 143.

With the first sealing device 125 closed and with the receptacle 105 connected, the first aseptic zone 127 is essentially formed or defined by the inside surfaces of the bellows 125, the bottom surface of the base plate 145, inside lateral surfaces in the openings of the carrier plate 131 and of the sealing plate 135 and the connecting piece 129 of the receptacle 105 and its diaphragm 103. In particular, as a result the first sealing device 125 forms a first aseptic zone 127 around the connecting piece 129 of the receptacle 105 and around the filling nozzle 111.

In addition, the filling device 100 includes a sterilizing device 107 for sterilizing at least the diaphragm 103 in order to kill off any germs on the diaphragm 103, and a puncturing device 109 for puncturing the diaphragm 103 in the first aseptic environment 127 in order then to be able to fill the receptacle 105 with the liquid. The sterilant can be water vapor and/or hydrogen peroxide, for example. Generally, however, it is also possible to use other sterilants which are suitable to kill off germs on the diaphragm. At least the diaphragm 103 and the channel 130 in the connecting part 129 above the diaphragm 103 are sterilized.

The filling nozzle 111 is provided with a first channel 113 and a second channel 115. The first channel 113 is formed by an inside pipe 117 and the second channel 115 is formed by an outside pipe 119 which here is preferably concentric. In detail, the second channel 115 is provided by the annular gap formed between the inside pipe 117 and the outside pipe 119. The inside pipe 117 and the outside pipe 119 are connected to one another by means of the base plate 145 and the flange plate 146. In one embodiment, the first channel 113 is a channel for supplying the sterile nutritional liquid and the second channel 115 is a channel for supplying the sterilant. In another embodiment, the first channel 113 is a channel for supplying the sterilant and for supplying the sterile nutritional liquid. The second channel 115 is a channel for sucking out the sterilant. In this case, a sterilizing of the diaphragm with the sterilant is carried out initially by means of the first channel 113 and then the receptacle 105 is filled by means of the same channel 113. The second channel 115 is used for the purpose of sucking out the sterilant prior to filling. The inside pipe 117 and/or the outside pipe 119 are formed, for example, by a metal or plastic pipe. The liquid is guided from a tank to the receptacle 105 in the inside pipe 117 when filling. In order to enable portioning of the liquid, the filling device 100 can comprise suitable valve control.

The connecting piece 129 of the pre-sterilized container 105 is provided with the thin diaphragm 103. The diaphragm 103 can be a non-reclosable or a reclosable diaphragm. A vapor blast, for example, is introduced onto the diaphragm 103 through the annular gap in order to kill off germs on the diaphragm 103 and in the interior of the connecting piece 129 of the receptacle 105. The outside pipe 119 of the filling nozzle 111 comprises an outside sealing cone 121 for sealing the filling nozzle 111 in relation to the connecting piece 129. In addition, the outside pipe 119 comprises a beveled end 123 for piercing or opening the diaphragm 103. The filling nozzle 111 and the connecting piece 129 of the receptacle 105 are matched to one another with regard to their dimensions.

Figure 2:
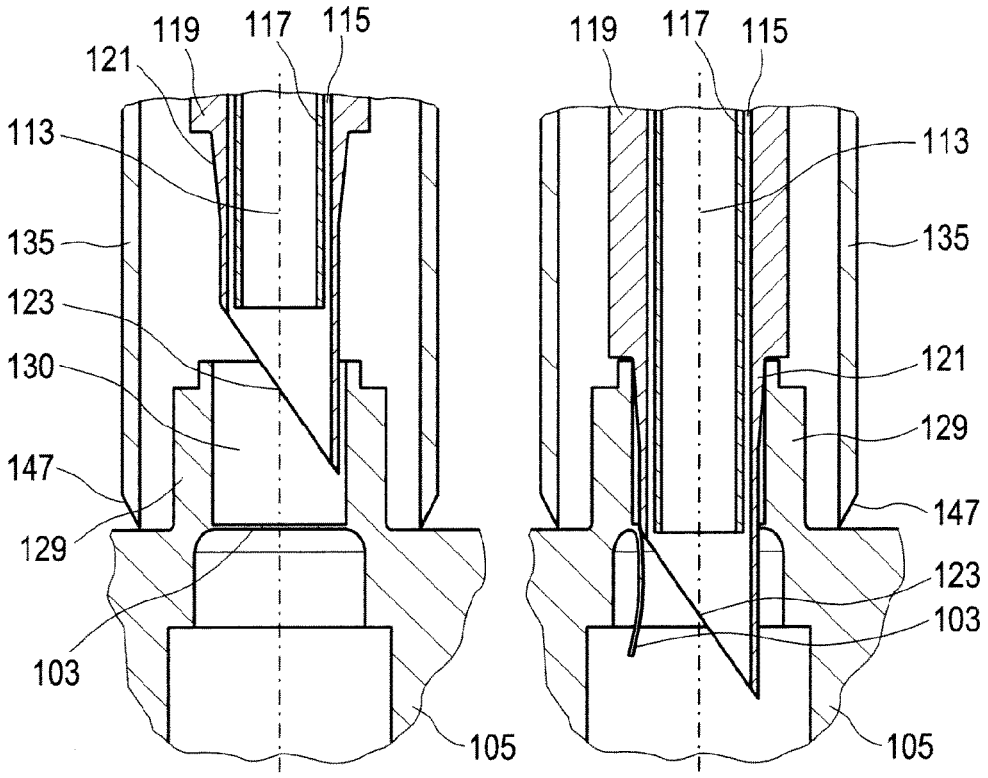
FIG. 2 shows an enlarged cross sectional view of the filling nozzle and of the receptacle with the diaphragm closed and the filling nozzle not introduced (left-hand figure) and with the diaphragm punctured and here opened and the filling nozzle introduced (right-hand figure)

FIG. 2 shows an enlarged cross sectional view of the filling nozzle 111 and of the receptacle 105 which is connected by means of the connecting piece 129 prior to (left-hand figure) and after (right-hand figure) piercing the diaphragm 103 of the connecting piece 129. The opening 139 in the sealing plate 135 is shown schematically here as a pipe. The opening 139 in the sealing plate 135 is realized at its end with a cutting edge 147. The closure of the first aseptic zone 127 is provided together with the connecting piece 129 of the receptacle 105. The top flange surface of the connecting piece 129 serves as a sealing plane. The cutting edge 147 abuts in a flange-like manner against the connecting piece 129 which serves as the sealing plane. Said connection forms the bottom end of the aseptic zone 127. A hermetically tight connection which prevents ingress of germs is produced at this point by the contact.

As has already been stated above, the filling nozzle 111 is composed of the inside pipe 117 and the outside pipe 119. The inside pipe 117 and the outside pipe 119 are arranged concentrically in the example shown. The outside pipe 119 serves for the perforation or the opening of the diaphragm 103 of the connecting piece 129. The receptacle 105 is filled by means of the inside pipe. When using a pouch as the receptacle 105, this ensures that the pouch unfolds as a result of the filling pressure.

The movement device 104 is preferably realized as a movable gripper 104. For filling, the connecting piece 129, which is situated in the movement device 104, is moved upward until the cutting edge 147 of the sealing plate 135 contacts the flange surface. As the movement continues upward, the sealing gap 137, which in the open state protects the inside first aseptic zone 127 by means of a displacement flow to the outside, is closed. The first aseptic zone 127 is closed. The upwardly directed movement for introducing the cutting edge 147 to the connecting piece 129 of the receptacle 105 and for closing the sealing gap 137 is effected within the framework of the first movement, by way of which the first aseptic zone 127 is closed. With the first aseptic zone 127 closed, the inside surface of the connecting piece 129 and of the diaphragm 103 is briefly vaporized, preferably with water vapor. The water vapor impingement is provided, for example, for a an interval of between 0.1 s and 5 s. The water vapor is supplied in the example shown by means of the annular gap 115 between the preferably concentric inside pipe 117 and the outside pipe 119. The beveled end 123 of the outside pipe 119 is above the diaphragm 103 which has not yet been punctured and is consequently still closed.

In a second movement which connects to the first movement, the receptacle 105 is introduced to the filling nozzle 111 to such an extent that the filling nozzle 111 projects at least in portions into the channel of the connecting piece 129 of the receptacle 105. In this case, the filling nozzle 111 is introduced into the connecting piece 129 to such an extent that the diaphragm 103 is opened by the filling nozzle 111. the diaphragm 103 is perforated by the tip 123 of the outer filling nozzle 119 and is displaced to the side. To this end, the movement device 104 is moved with the receptacle 105 so far upward such that the carrier plate 131 is also pushed upward above the sealing plate 135. As a result, the bellows as the first sealing device 125 is reduced in its longitudinal extension. The side wall 125*a*, which defines the bellows 125, is modifiable in its height for this purpose. By compressing the bellows 125, the receptacle 105 is introduced to the filling nozzle 111. The diaphragm 103 of the connecting piece 129 is perforated by the beveled end 123 of the outside pipe 119 of the filling nozzle 111, which is fixed in this case. The filling nozzle 111 with the inside pipe 117 is moved so far into the receptacle 105 that the sealing cone 121 of the outer filling nozzle 119 closes the connecting piece 129 on the upper edge. Once the circumferential sealing cone 121 has been fitted on the upper edge of the connecting piece 129, the receptacle 105 is filled with the sterile liquid. Filling is effected here by means of the inside pipe 117. Once the filling operation has been concluded, the movement device 104 is moved downward together with the sealing plate 135 and the carrier plate 131 in a third movement until the sealing gap 137 is opened again. Under the shielding of the displacement flow, for example with nitrogen, the movement device 104 and the sealing plate 135 are displaced, preferably horizontally, in the direction of the laterally arranged closing device 200 (see the description regarding FIG. 3 below in this respect).

In addition, the filling nozzle 111 is cleaned sterilized and/or dried after the filling operation, in particular by way of the device 143. The further method steps, in particular the closing of the receptacle 105 by the closing device 200 is explained below in conjunction with FIG. 3.

Figure 3:
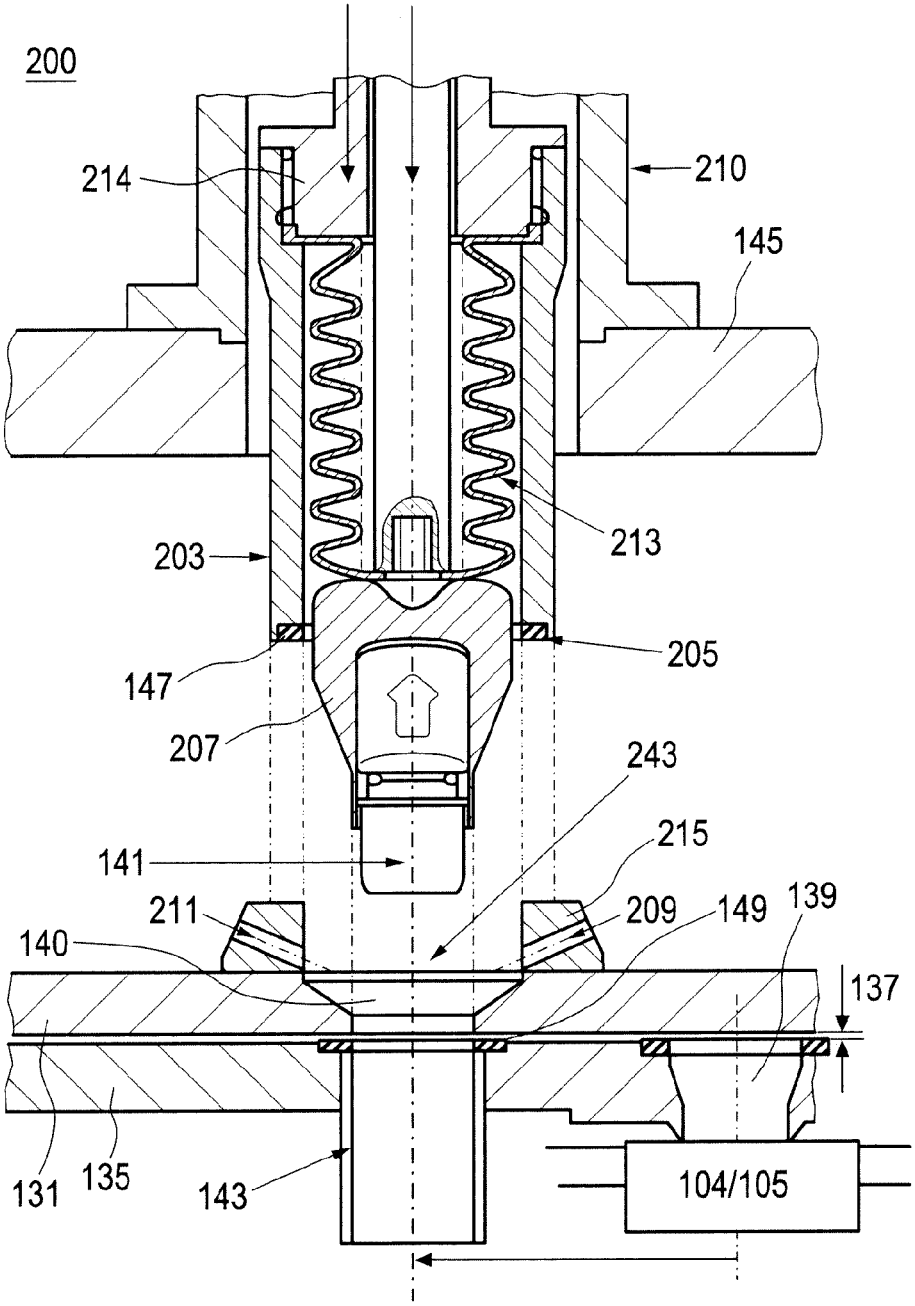
FIG. 3 shows a cross sectional view of a closing device of the installation for aseptic filling with the closure cap removed and the receptacle not yet introduced.

FIG. 3 shows a cross sectional view of a closing device 200. Said closing device serves for closing the receptacle 105 in a second aseptic zone 204 with a closure cap 141. The closing device 200 together with the filling device 100 is preferably a component part of an installation according to the invention for aseptic filling of a receptacle 105 with a sterile enteral nutritional solution. FIG. 3 shows the closing device 200 with a closure cap 141 which is introduced but not yet mounted on the connecting piece 129 of the receptacle 105. The receptacle 105 here is not yet positioned below the closing device 200. The gripper 104 with the received receptacle 105 is shown in a simplified manner in FIG. 3 by way of a box (see the bottom right-hand side).

The closing device 200 is fastened on a base plate 145. In one development, the closing device 200 and the filling device 100 have associated therewith the same base plate 145 and/or the same carrier plate 131. The closing device 200 includes a second sealing device 203 for forming a second aseptic zone 204, in particular at least around the connecting piece 129 of the receptacle 105.

The second sealing device 203 includes here a protective bell 203 or is realized as a protective bell 203. The protective bell 203 is open toward the bottom. It forms at least the side walls of the second sealing device 203. The protective bell 203 shown is realized here as a type of pipe which extends through the base plate 145. The walls of the protective bell 203 are not modifiable in their length. The protective bell 203 is connected to the base plate 145 by means of a closing unit 210 which is arranged above the base plate 145. The protective bell 203 is arranged so as to be movable inside the closing device 200.

A cap gripper 207 is arranged inside the protective bell 203. The cap gripper 207 serves for gripping the closure cap 141. It is connected to a pneumatic device 213 for pressing-on the closure cap 141 by means of a boundary which is displaceable, preferably vertically.

The displaceable boundary 213 is realized as a bellows 213 in the example shown. The compressed air, for example, can be guided in the interior of the bellows 213 and in the channel connecting thereto. The pneumatic device 213 for fitting, preferably for pressing-on the closure cap is preferably a pneumatic cylinder 213. The positioning or movement of the protective bell 203 and of the pneumatic cylinder 213 is effected, for example, by way of an electromechanical cylinder which is not shown in the figures. The movement of the bellows 213 to press-on the closure cap 141 is indicated by way of the arrow shown at the top on the right. The movement for fitting the protective bell 203 onto the carrier plate 131 is indicated by way of the arrow shown at the top on the left.

FIG. 3 shows the closing device 200 and consequently also the second sealing device 203 in the open state. In the closed state of the second sealing device 203, the bottom surface of the protective bell 203 bears sealingly against the top surface of the carrier plate 131. A sealing ring 205 is arranged on the bottom surface of the protective bell 203 for this purpose. In the example shown, the protective bell 203 rests indirectly on the top surface of the carrier plate 131. It rests sealingly on the carrier plate 131 by means of a connecting component 215.

At least one channel is arranged in the connecting component 215. Two channels 209 and 211 are shown here. Sterile air, for example, for drying can be supplied and/or removed by means of the channel 211 shown on the left-hand side. Vapor for sterilization can be supplied and/or removed by means of the channel 209 shown on the right-hand side. As an alternative to this or in addition to it, these can also be supplied and/or removed by means of the device 143 for cleaning, sterilizing and/or drying.

The sealing plate 135 is arranged below the carrier plate 131. A gap 137 for a displacement flow is realized between the two plates 131 and 135 with the second aseptic zone 204 in an open state. For further details regarding the carrier plate 131 and the sealing plate 135, reference is made to the preceding statements regarding FIG. 1.

CIP/SIP flushing lines 143, by means of which a sterilant is supplied and/or removed again from the second aseptic zone 127, 204, are arranged below the opening 140 in the carrier plate 131. The gripper 104 for the connecting piece 129 of the receptacle 105 is situated laterally offset, here to the right, of the CIP/SIP flushing lines 143. They are positioned below the opening 139 in the sealing plate 135, by means of the horizontal movement of which to the left the connecting piece 129 is supplied to the closing device 200.

FIG. 3 shows the second sealing device 203 in an open position. It can be opened, for example, by the protective bell 203 being moved upward and/or by the carrier plate 131 being moved upward. To provide or close the second aseptic zone 204, the protective bell 203 is moved downward until its bottom surface abuts sealingly against the carrier plate 131. With the second sealing device 203 closed and the receptacle 105 connected, the second aseptic zone 204 is essentially formed or defined by the inside surfaces of the protective bell 203, the outside surface of the bellows 213, the inside surface of the connecting component 215, the lateral surface inside surfaces in the openings 140 and 139 of the carrier plate 131 and of the sealing plate 135 as well as the connecting piece 129 of the receptacle 105. In particular, the second sealing device 203 as a result forms an aseptic zone 204 around the connecting piece 129 of the receptacle 105. The further steps, in particular the closing of the receptacle 105 by the closing device 200, are explained below. The second sealing device 203 of the closing device 200 is opened for inserting the closure 141. In the present example according to FIG. 3, it is opened by the protective bell 203 being moved upward. This occurs in particular whilst the container 105 is moved into the gripper 104 below the filling device 100 within the framework of the first movement.

A, preferably pre-sterilized, closure 141 is removed from a conveying system (not shown here) by way of a pivoting gripper and is positioned in alignment under the cap gripper 207. The cap gripper 207 is moved onto the closure 141 from above in order to take over said closure once a separate pivoting gripper has been opened. As a result, the closure 141 is introduced into the open, second aseptic zone 204. The protective bell 203 is then moved down and closes the second aseptic zone 204. In order to achieve a hermetic seal, on the bottom end the second sealing device 203 comprises the sealing ring 205 which is moved into abutment with the carrier plate 131, here indirectly, when the second aseptic zone 204 is closed. The positioning of the second sealing device 203 and of the pneumatic cylinder 213 for pressing-on the closure 141 is effected, for example, by means of an electromechanical cylinder.

In particular, whilst the receptacle is being filled in the filling device 100, a flushing line 143, for example a CIP/SIP flushing line, is lined up in the closing device 200 below the carrier plate 131, preferably in alignment with the opening in the carrier plate 131. Consequently, substantially parallel to the filling of the receptacle 105 up to briefly prior to the pressing-on, the closure 141 can be sterilized, preferably by means of vapor, and dried, preferably by means of sterile air. To this end, the right-hand channel 209 can be provided for introducing vapor into the second aseptic zone 204 and the left-hand channel 211 for introducing sterile air into the second aseptic zone 204.

In particular during the displacement of the receptacle 105, which is preferably filled at the same time, into the position in alignment with the closing device 200, the protective bell 203 remains closed. The displacement flow in the sealing gap 137, brought about by overpressure, protects the second aseptic zone 203 against contamination. The flushing line 143 in the sealing plate 143 can be used, for example, for this purpose.

Once the filling operation in the filling device 100 has been concluded, the gripper 104 is moved downward together with the sealing plate 135 and the carrier plate 131 until the sealing gap 137 opens again. This occurs in a third and fourth movement. Under the shielding of the displacement flow, in particular with nitrogen, the gripper 104 and the sealing plate 135 are displaced, preferably horizontally, in the direction of the closing device 200 which is arranged laterally here. The opening 139 of the sealing plate 135 is displaced under the closing device 200 within the protection of a displacement flow. The just filled receptacle 105 is moved into alignment with the closing device 200 in this manner under a protective atmosphere. This occurs within the framework of a fifth movement.

The gripper 104 is then moved upward again such that the carrier plate 131 and the sealing plate 135 close the gap 137 by means of the sealing ring 149 and the second aseptic zone 204 is closed inside the closing device 200. This occurs within the framework of a sixth movement. Once the gap 137 has been closed, the pressing-on of the closure 141 is effected inside the closed second aseptic zone 204, for example as a result of pressing-on the closure cap 141 pneumatically. Within the framework of a seventh movement, the receptacle, closed by way of the closure cap 141, is removed from the second sealing device 203 by means of a downward movement of the gripper 104 such that the second aseptic zone 204 is opened. The filled and now closed receptacle 105 can be supplied away from the closing device 200 for subsequent processing, for example for labeling and/or further packaging. The operation in the closing device 200 can then start from the beginning, in particular with the introduction of the closure 141 by way of the separate pivoting gripper from the supplying and conveying system.

In particular substantially parallel to the closing of the receptacle 105 inside the closed second aseptic zone 204 in the closing device 200, at least one cleaning and/or sterilization, in particular pulse cleaning and/or sterilization, of the filling nozzle 111 is carried out in the filling device 100. However, this is not shown in the figures. To this end, the opening 133 in the carrier plate 131 moves into alignment with the opening for the flushing line 143 (CIP/SIP flushing line) in the sealing plate 135. The filling nozzle 111 can be flushed, exposed to vapor and dried in this manner shortly after the receptacle 105 has been filled. As a result, a cleaned filling nozzle 111 is always the starting point for each subsequent process for filling a receptacle 105. The operation in the filling device 100 can then start from the beginning, in particular with the introduction of a further receptacle 105 to be filled to the first sealing device 125.

As a result of the filling nozzle 111 being flushed and exposed to vapor in a quasi-continuous manner, only being interrupted periodically by the filling process, substrate formation is avoided and germ formation countered. Along with this, time-consuming intermediate cleaning cycles can be omitted. As a result of the very small inner volumes of the filling nozzle 111, a relatively high flushing rate can be achieved within a short time in order to be able to exclude build-up of product residues. Interruption-free processing of a production batch with a high level of installation productivity is made possible as a result. The filling installation is only subject to intensive cleaning and vapor sterilization of all product-conducting parts as well as of the minimized clean room during a format and/or batch change.

As a result, a brief cleaning and sanitizing of the filling nozzle 111 is obtained after each filling process. Germ growth on the inner surfaces of the filling nozzle 111 can essentially be excluded. Formation of deposits is essentially prevented. Thermal pulse impingement for sanitization is effected as a result of the condensing water vapor. The installation according to the invention provides the aseptic zone 127 and 204 with a small volume and a small surface which are just a fraction of the volume or of the surface in conventional filling installations. The aseptic zone is able to be sterilized simply and quickly as a result. The volume of the first aseptic zone 127 and/or of the second aseptic zone 204 is only a few cubic centimeters in size. Its volume is preferably less than 250 $cm^3$.

It is obvious to the expert that the described embodiments are to be understood as an example. All the individual features explained in the description and shown in the figures are able to be combined with one another in a different manner in order to realize the advantageous effects thereof at the same time. The invention is not limited to the exemplary embodiments explained in connection with the drawings, but is provided by the scope of protection of the claims.

LIST OF REFERENCES

100 Filling device
103 Diaphragm
104 Movement device or gripper
105 Receptacle
107 Sterilizing device
109 Puncturing device
111 Filling nozzle
113 First channel
115 Second channel or annular gap
117 Inside pipe
119 Outside pipe or outer filling nozzle
121 Sealing cone
123 Beveled end or tip of the filling nozzle
125 First sealing device
**125*a*** Side walls of the first sealing device
**125*h*** Longitudinal extension of the first sealing device
127 First aseptic zone
129 Connecting piece or port
130 Channel in the connecting piece
131 Carrier plate
133 Opening in the carrier plate (in the filling device or the first aseptic zone)
135 Sealing plate
137 Gap
139 Opening in the sealing plate
140 Opening in the carrier plate (in the closing device or the second aseptic zone)
141 Closure or closure cap
143 Flushing line or device for cleaning, drying and/or flushing
145 Base plate
146 Annular flange or flange plate
147 Cutting edge
149 Sealing ring
200 Closing device
203 Second sealing device
204 Second aseptic zone
205 Sealing ring
207 Cap gripper or closure gripper
209 Channel
210 Closing unit
211 Channel
213 Pneumatic device or pneumatic cylinder
214 Electromechanical cylinder
215 Connecting component

The invention claimed is:

1. A method for aseptic filling of a receptacle with nutritional solution, said method including the following steps:

providing a filling device with a first sealing device in which at least one filling nozzle is arranged and in which a first aseptic zone is provided and wherein the first sealing device is situated in a position which comprises an opening;

gripping a receptacle, which includes at least one connecting piece with a channel for filling the receptacle, by way of a gripper;

introducing the receptacle into the first sealing device in a first movement in such a manner that the receptacle abuts sealingly against the opening of the first sealing device and the first aseptic zone, in which at least the connecting piece of the receptacle is arranged, is closed;

supplying a sterilant into the first aseptic zone such that at least the channel of the connecting piece of the receptacle is sterilized;

introducing the receptacle to the filling nozzle inside the first aseptic zone in a second movement in such a manner that the first sealing device is reduced in its longitudinal extension and the filling nozzle is able to fill the receptacle by means of the channel of the connecting piece;

filling the receptacle through the channel in the connecting piece with the nutritional solution in the first aseptic zone by means of the filling nozzle; and fitting a closure onto the channel of the connecting piece in an aseptic environment such that the filled receptacle is closed in an aseptic manner, wherein the closure is fitted onto the channel of the connecting piece in a closing device, wherein the closing device is provided with a second sealing device in which a closure gripper is arranged and in which a second aseptic zone can be provided.

2. The method as claimed in claim 1, wherein the receptacle is introduced to the filling nozzle in the second movement in such a manner that the filling nozzle projects at least partially into the channel of the connecting piece of the receptacle and/or the filling nozzle is moved so far into the connecting piece of the receptacle that an outside surface of the filling nozzle abuts against the connecting piece and closes the channel in the connecting piece.

3. The method as claimed in claim 2, wherein the outside surface of the filling nozzle is in the form of a sealing cone of the filling nozzle and abuts against the connecting piece and closes the channel in the connecting piece in a sealing manner.

4. The method as claimed in claim 1, wherein the first aseptic zone is reduced in its longitudinal extension by the second movement in which the receptacle is introduced to the filling nozzle and/or the receptacle to be filled is provided with a closed, sterile interior and wherein the connecting piece is sealed by way of a diaphragm which is puncturable by means of the filling nozzle.

5. The method as claimed in claim 4, wherein the diaphragm is located below the channel of the connecting piece and is configured to have a closed state and wherein the diaphragm is in its closed state and at least the channel of the at least one connecting piece, which is located above the closed diaphragm, is sterilized by the sterilant and the sterilized diaphragm is opened prior to the filling of the receptacle and/or the receptacle is introduced to the filling nozzle in such manner in the second movement that the sterilized diaphragm is opened by the filling nozzle.

6. The method as claimed in claim 1, wherein the second sealing device is opened for receiving the closure, which is fitted onto the connecting piece, which is removed from a conveying system by way of a gripping element, and which is transferred to the closure gripper, which is positioned in the open second sealing device and/or wherein the second sealing device is closed and the closure is cleaned, sterilized and/or dried in the closed second sealing device.

7. The method as claimed in claim 6, wherein once the filling operation has been concluded, the filled receptacle is moved away from the filling nozzle in a third movement and in a fourth movement the filled receptacle is removed from the first sealing device and/or the filled receptacle is moved from the filling device to the closing device in a fifth movement such that at least a region of the connecting piece, in which the channel for filling and an opened diaphragm are situated in a protected atmosphere and/or the receptacle is introduced to the second sealing device of the closure device and is applied against it in a sealing manner in a sixth movement in such a manner that a closed, second aseptic zone in which the closure is fitted onto the connecting piece of the filled receptacle is provided about the closure and at least about the region of the connecting piece in which the channel for filling and the opened diaphragm are situated.

8. The method as claimed in claim 7, wherein the receptacle, which is closed by way of the closure, is removed from the second sealing device in a seventh movement such that the second aseptic zone is open or the receptacle is held in a sealing manner against an opening in a sealing plate, and the sealing plate is placed in a sealing manner against the first sealing device for closing the first aseptic zone and/or once the filling operation is concluded, the sealing plate, together with the receptacle which is held in a sealing manner against the opening in the sealing plate, is displaced away from the first sealing device and toward the second sealing device and is placed in a sealing manner against the second sealing device for providing the closed, second aseptic zone.

9. The method as claimed in claim 8, wherein the first sealing device of the filling device abuts against a carrier plate and/or the second sealing device of the closing device is placed in a sealing manner against the carrier plate and/or the sealing plate, together with the receptacle, which is held in a sealing manner against the opening of the sealing plate, is displaced from the filling device to the closing device and/or vice versa, thereby forming a gap between the sealing plate and the carrier plate, wherein a protective atmosphere is provided at least in the gap, for example as a result of a displacement flow to the outside.

10. An installation for aseptic filling of a receptacle which comprises at least one connecting piece with a channel for filling the receptacle with a nutritional solution, said installation including:

a filling device with a first sealing device, which is adjustable in the longitudinal extension and comprises a closable opening, in which at least one filling nozzle is arranged, and in which a closed first aseptic zone can be provided by means of closing the opening, a device for supplying a sterilant into the first aseptic zone such that at least the channel of the connecting piece of the receptacle is sterilizable;

a gripper for holding and for introducing the receptacle to the first sealing device in a first movement in such a manner that the receptacle can be placed in a sealing manner against the opening of the first sealing device and the first aseptic zone, in which at least the connecting piece of the receptacle is arranged, can be closed, wherein the gripper is configured for introducing the receptacle to the filling nozzle inside the first aseptic zone in such a manner in a second movement that the filling nozzle can fill the receptacle by means of the channel of the connecting piece in the first aseptic zone, and a closing device for fitting a closure onto the connecting piece of the receptacle wherein for fitting the closure onto the connecting piece of the receptacle, the closing device includes a second sealing device which includes a closable opening and in which a second aseptic zone can be provided.

11. The installation as claimed in claim 10, wherein the gripper is configured to introduce the receptacle to the filling nozzle in such a manner in the second movement that the filling nozzle is able to project into the channel of the connecting piece of the receptacle.

12. The installation as claimed in claim 10, wherein the first sealing device is configured to be compressed when the receptacle is introduced to the filling nozzle and/or the first sealing device includes a side wall which is formed at least in portions by a bellows, which extends around the filling nozzle, and/or by a telescopic system, which extends around the filling nozzle, produced from pipes which can be displaced in relation to one another.

13. The installation as claimed in claim 10, wherein the device for supplying the sterilant comprises the filling nozzle and/or wherein the filling nozzle is configured as a mandrel for opening a diaphragm that is provided in the connecting piece of the receptacle.

14. The installation as claimed in claim 10, wherein the filling nozzle includes a first channel for supplying a nutritional solution and a second channel for supplying a sterilant or in that the filling nozzle includes a first channel for supplying a sterilant and/or a nutritional solution and a second channel for sucking out a sterilant and/or a nutritional solution, wherein the first channel of the filling nozzle is formed by an inside pipe and the second channel of the filling nozzle by an outside pipe and/or the filling nozzle includes an outside sealing cone for sealing the filling nozzle in relation to the receptacle.

15. The installation as claimed in claim 10, wherein, the filled receptacle is movable from the filling device to the closing device by means of the gripper, and/or a closure gripper is movably arranged in the second sealing device, by way of which closure gripper the closure is able to be fitted onto the connecting piece of the filled receptacle by means of a pneumatic device.

16. The installation as claimed in claim 10, comprising a sealing plate, wherein the receptacle can be held in a sealing manner against an opening in the sealing plate by means of the gripper, and the sealing plate can be placed against the first sealing device for closing the first aseptic zone and/or the first sealing device of the filling device abuts against a carrier plate and the sealing plate can be placed in a sealing manner against the carrier plate by means of the gripper for closing the first aseptic zone.

17. The installation as claimed in claim 16, wherein the second sealing device of the closing device can be placed against the carrier plate for providing the second aseptic zone and the sealing plate can be placed in a sealing manner against the carrier plate for closing the second aseptic zone by means of the gripper and/or wherein the sealing plate together with the receptacle which is held in a sealing manner against the opening of the sealing plate, can be displaced away from the first sealing device by means of the gripper and toward the second sealing device and can be placed in a sealing manner against the second sealing device for closing the second aseptic zone.

18. The installation as claimed in claim 17, comprising a movably arranged device for cleaning, sterilizing and/or drying which is abuttable against the first sealing device and/or against the second sealing device, wherein the device for cleaning, sterilizing and/or drying is arranged on the sealing plate.

19. The installation as claimed in claim 16, wherein the sealing plate is movable thereby forming a gap between the sealing plate and the carrier plate, wherein a displacement flow is providable in the gap which is formed between the sealing plate and the carrier plate.

* * * * *